US007427985B2

(12) United States Patent
Chen et al.

(10) Patent No.: US 7,427,985 B2
(45) Date of Patent: Sep. 23, 2008

(54) INTEGRATED CIRCUIT FOR DRIVING LIQUID CRYSTAL DISPLAY DEVICE

(75) Inventors: Chien Chih Chen, Jhudong Township, Hsinchu County (TW); Chi Mao Hung, Chiayi (TW); Chih Yueh Lo, Jhunan Township, Miaoli County (TW)

(73) Assignee: Au Optronics Corp., Hsinchu (TW)

( * ) Notice: Subject to any disclaimer, the term of this patent is extended or adjusted under 35 U.S.C. 154(b) by 693 days.

(21) Appl. No.: 10/975,370

(22) Filed: Oct. 29, 2004

(65) Prior Publication Data

US 2005/0128171 A1 Jun. 16, 2005

Related U.S. Application Data

(60) Provisional application No. 60/515,657, filed on Oct. 31, 2003.

(51) Int. Cl.
*G09G 5/00* (2006.01)

(52) U.S. Cl. ..... 345/204; 345/87; 345/211

(58) Field of Classification Search ..... 345/204, 345/87, 211
See application file for complete search history.

(56) References Cited

U.S. PATENT DOCUMENTS

| | | | | |
|---|---|---|---|---|
| 5,144,288 | A * | 9/1992 | Hamada et al. | 349/109 |
| 5,982,347 | A | 11/1999 | Shigeta | |
| 6,271,822 | B1 | 8/2001 | Chiang | |
| 6,891,427 | B2 | 5/2005 | Tsutsui et al. | |
| 6,985,128 | B1 | 1/2006 | Kida et al. | |
| 7,027,017 | B2 * | 4/2006 | Yer | 345/87 |
| 7,110,274 | B1 * | 9/2006 | Endo et al. | 363/147 |
| 7,176,869 | B2 | 2/2007 | Kumada et al. | |
| 7,193,677 | B2 * | 3/2007 | Ino | 349/149 |
| 7,307,610 | B2 | 12/2007 | Sakaguchi | |
| 2003/0090614 | A1 | 5/2003 | Kim et al. | |
| 2004/0056832 | A1 | 3/2004 | Abe | |
| 2004/0095305 | A1 | 5/2004 | Kimura et al. | |
| 2007/0052649 | A1 | 3/2007 | Nakajima et al. | |

FOREIGN PATENT DOCUMENTS

| | | |
|---|---|---|
| CN | 1104339 | 6/1995 |
| CN | 1334555 | 2/2002 |
| CN | 1386211 | 12/2002 |
| CN | 1386255 | 12/2002 |
| CN | 1561469 | 1/2005 |
| WO | WO2004049296 | 6/2004 |

OTHER PUBLICATIONS

JP Office Action mailed May 21, 2008 and the English Translation.

* cited by examiner

*Primary Examiner*—Richard Hjerpe
*Assistant Examiner*—Leonid Shapiro
(74) *Attorney, Agent, or Firm*—Thomas, Kayden Horstemeyer & Risley

(57) ABSTRACT

A liquid crystal display (LCD) device connectable to a power source includes a substrate, a panel including an array of thin film transistors provided on the substrate, and a first integrated circuit (IC). The first IC includes a timing controller for providing control signals and video signals, a source driver for receiving the control signals and video signals and driving the panel, and a common voltage circuit for providing a common voltage to the panel.

36 Claims, 6 Drawing Sheets

INTEGRATED CIRCUIT FOR DRIVING LIQUID CRYSTAL DISPLAY DEVICE

DESCRIPTION OF THE INVENTION

This application claims priority to U.S. Provisional Application Ser. No. 60/515,657, filed Oct. 31, 2003, the entire contents of which are incorporated herein by reference.

FIELD OF THE INVENTION

This invention relates in general to a liquid crystal display ("LCD") device and, more particularly, to an integrated circuit for driving an LCD device.

BACKGROUND OF THE INVENTION

A thin film transistor ("TFT") typically may be classified as an amorphous TFT or a polysilicon TFT. An amorphous TFT is generally fabricated using an amorphous silicon ("α-Si") technique, and a polysilicon TFT may be fabricated using a low-temperature polysilicon ("LTPS") technique. LTPS TFTs have electron mobility greater than 200 $cm^2$/V-sec and hence can have a smaller dimension, a larger aperture ratio and a lower power rating. FIG. 1 is a block diagram of a conventional LTPS LCD device 10. LCD device 10 includes a panel 12, a backlight 14, a timing controller 16, and a light emitting diode ("LED") driver 18. Timing controller 16 provides control signals and video signals to panel 12 through a flexible printed circuit ("FPC") 20 coupled to panel 12. LED driver 18 drives backlight 14 to illuminate panel 12. LCD device 10 generally operates in a mixed-voltage environment, which may use different voltage levels of, for example, 3 volts (V), 5V, 8.5V and −4V. These different voltage levels generally are provided by external sources. It may be costly to manage these external sources. Furthermore, timing controller 16 and LED driver 18 are formed in separate integrated circuits, disadvantageously resulting in an increase of device size.

SUMMARY OF THE INVENTION

The present invention relates to a drive circuit for a liquid display device that obviates one or more of the problems due to limitations and disadvantages of the related art.

Consistent with the present invention, there is provided a liquid crystal display (LCD) device connectable to a power source that includes a substrate, a panel including an array of thin film transistors provided on the substrate, and a first integrated circuit (IC). The IC includes a timing controller for providing control signals and video signals, a source driver for receiving the control signals and video signals and driving the panel, and a common voltage circuit for providing a common voltage to the panel.

Also consistent with the present invention, there is provided a liquid crystal display (LCD) device connectable to a power source that includes a substrate, a panel including an array of thin film transistors provided on the substrate, and a first integrated circuit (IC) mounted on the substrate using a chip-on-glass (COG) technique. The first IC includes a timing controller connectable to the power source for providing control signals and video signals, a source driver for receiving the control signals and video signals and driving the panel, a common voltage circuit for providing a common voltage to the panel, and a first DC/DC control circuit connectable to the power source for providing one or more power supplies to the LCD device.

Additional features and advantages of the invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

In the drawings.

DESCRIPTION OF THE EMBODIMENTS

Reference will now be made in detail to the present embodiment consistent with the invention, an example of which is illustrated in the accompanying drawings. Wherever possible, the same reference numbers will be used throughout the drawings to refer to the same or like parts.

The present invention provides for LCD devices that obviate one or more of the problems associated with conventional LCD devices. Embodiments consistent with the present invention are described with reference to FIGS. 2-6.

Figure 1:
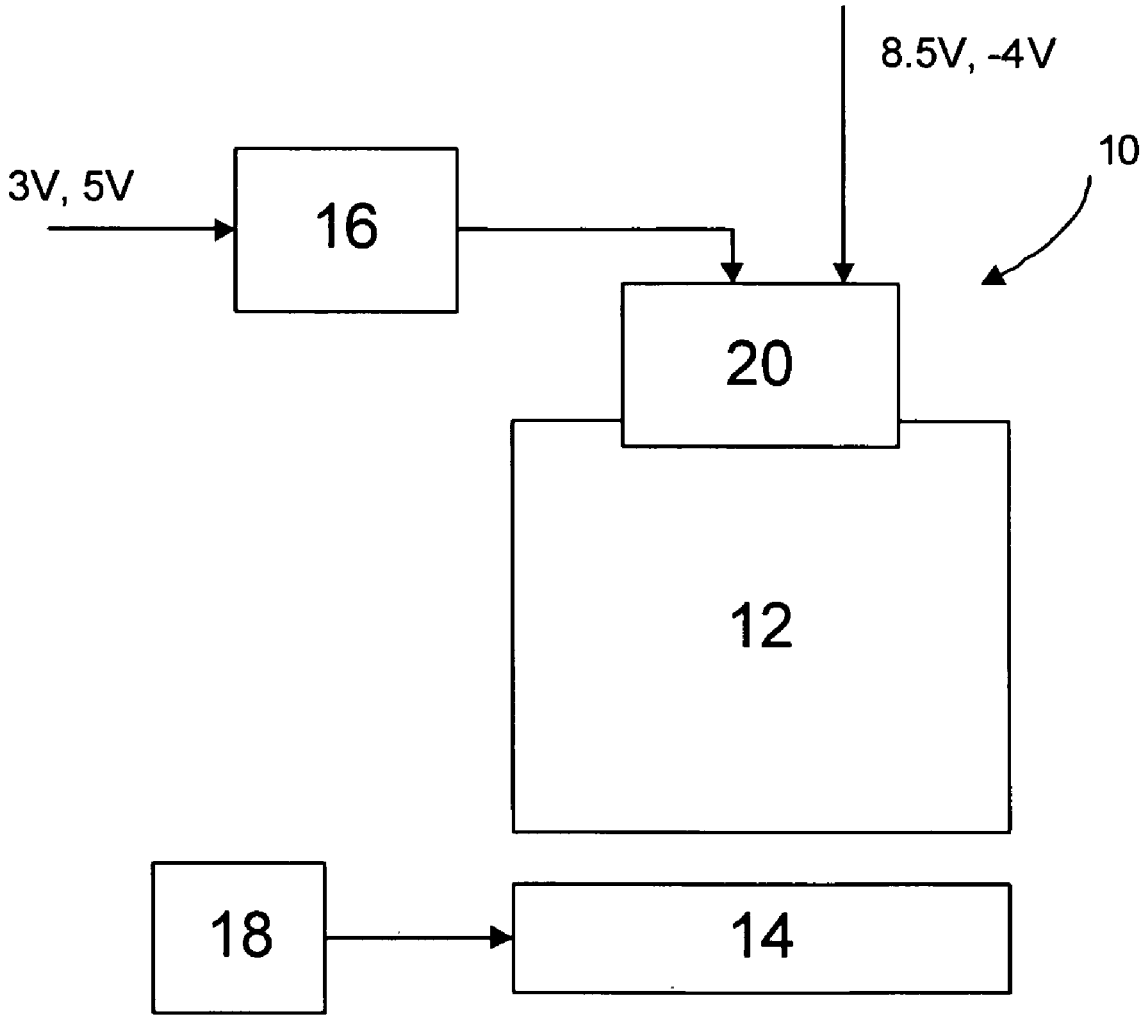
Fig. 1 PRIOR ART
FIG. 1 is a block diagram of a conventional low-temperature polysilicon ("LTPS") liquid crystal display ("LCD") device.
Figure 2:
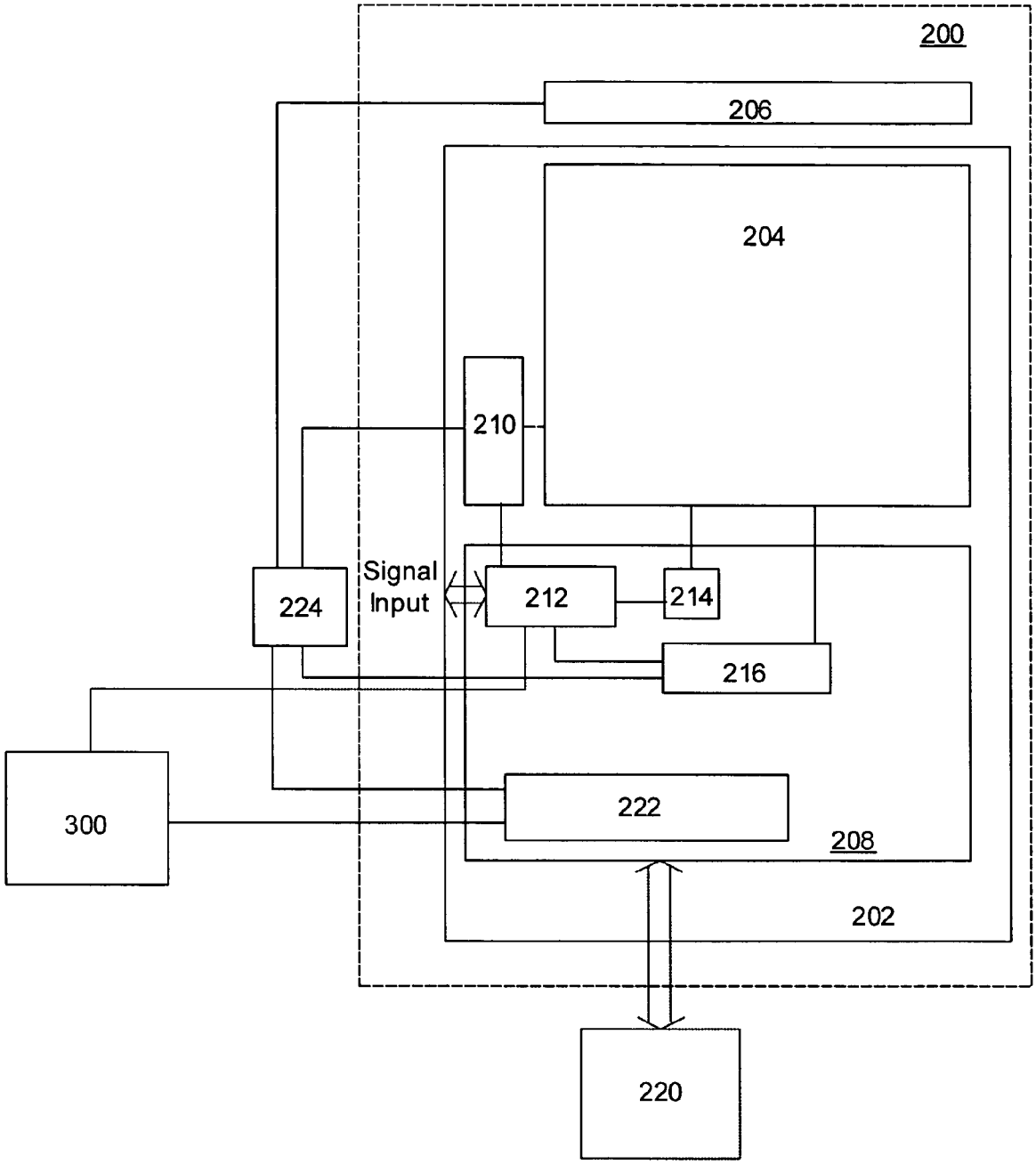
FIGS. 2-6 are block diagrams of liquid crystal display ("LCD") devices consistent with embodiments of the present invention.

FIG. 2 is a block diagram of a liquid crystal display ("LCD") device 200 consistent with a first embodiment of the present invention. LCD device 200 includes a substrate 202 and a panel 204 formed on substrate 202. Substrate 202 may comprise a glass substrate. Panel 204 includes a plurality of pixel elements (not shown) and a plurality of thin film transistor (TFT) devices (not shown), each pixel element being driven by a corresponding TFT device. In one aspect, the pixel elements are arranged to form a triangular array, which is known as a delta configuration. In another aspect, the TFT devices are formed using an amorphous silicon (α-Si) technique. In still another aspect, the TFT devices are formed using a low temperature polysilicon (LTPS) technique.

LCD device 200 also includes a light source 206 for illuminating panel 204, an integrated circuit ("IC") 208, and a gate driver 210 for driving panel 204.

IC 208 is mounted on substrate 202 using a chip-on-glass ("COG") technique and includes a timing controller 212, a source driver 214, and a common voltage circuit 216. Timing controller 212 receives signal input from external sources. The signal input may include video signals and control signals. Video signals generally include digital R (red), G (green), and B (blue) signals, and control signals generally include vertical synchronization signals and horizontal synchronization signals. Timing controller 212 then provides corresponding control signals and video signals to source driver 214, common voltage circuit 216, and gate driver 210. For example, synchronization signals may be provided to source driver 214 and common voltage circuit 216 for synchronizing the operations thereof. Source driver 214 receives the control signals and video signals from timing controller 212 and drives panel 204 by providing signals to the TFT's of panel 204. Common voltage circuit 216 receives the control signals from timing controller 212 and provides a common voltage, $V_{com}$, to panel 204. In one aspect, common voltage circuit 216 provides for a $V_{com}$ swing and a line inversion mechanism to drive panel 204. In another aspect, IC 208 further includes a $V_{com}$ adjustment circuit (not shown) coupled to common voltage circuit 216 for adjusting an amplitude of $V_{com}$. In still another aspect, $V_{com}$ may be adjusted by externally providing a reference voltage to common voltage circuit 216.

Consistent with the first embodiment of the present invention, IC 208 provides support for a serial bus and is connectable to a microprocessor 220 through a serial bus connector (not shown). Microprocessor 220 may be used to control IC 208 or to set the features of IC 208.

Gate driver 210 receives control signals and video signals from timing controller 212 and drives panel 204 by providing signals to the TFT's of panel 204. In one aspect of the first embodiment of the present invention, gate driver 210 also comprises thin film transistors which may be formed on substrate 202 at the same time the TFT's of panel 204 are formed.

LCD device 200 is connectable to a power source 300, which provides a power supply ranging from, for example, approximately 2.7V to 3.6V. In one aspect, timing controller 212 is connectable to power source 300. Consistent with the first embodiment of the present invention, IC 208 also includes a DC/DC control circuit 222 connectable to power source 300 and also connectable to a peripheral circuit 224 for providing various voltage supplies. For example, DC/DC control circuit 222 coupled with peripheral circuit 224 may provide voltage supplies to common voltage circuit 216, gate driver 210, light source 206, and other portions of LCD device 200 that may require a voltage supply. In one aspect, DC/DC control circuit 222 and peripheral circuit 224 provide voltage supplies having levels of approximately −6.5V or 8.5V. In one aspect, peripheral circuit 224 may be provided on a printed circuit board (PCB). In another aspect, peripheral circuit 224 includes a charge pump (not shown) for providing a power supply voltage to gate driver 210. In still another aspect, peripheral circuit 224 includes a $V_{com}$ adjustment circuit (not shown) for providing a reference voltage to common voltage circuit 216 for adjusting $V_{com}$. In yet another aspect, peripheral circuit 224 includes a DC/DC converter (not shown) for providing a power supply voltage to light source 206.

Figure 3:
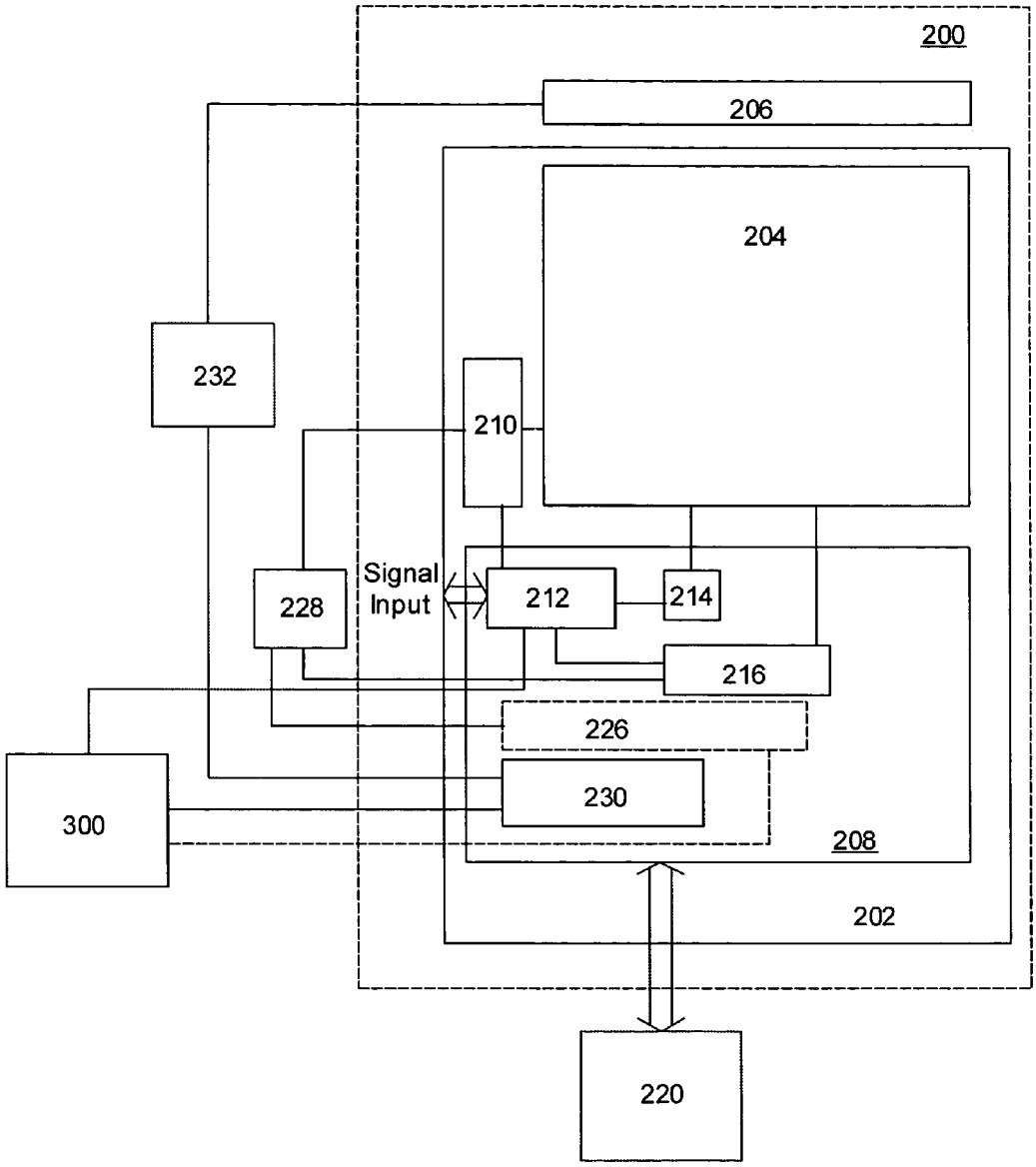

Consistent with a second embodiment of the present invention illustrated in FIG. 3, a first DC/DC control circuit 226 is connectable to a first peripheral circuit 228 for providing power supplies to common voltage circuit 216, gate driver 210, and source driver 214. IC 208 further includes a second DC/DC control circuit 230 connectable to a second peripheral circuit 232 for generating a power supply for light source 206. In FIGS. 2 and 3, the same reference numbers are used to refer to the same elements of the LCD device. In one aspect, first DC/DC control circuit 226 comprises a charge pump (not shown). In another aspect, first DC/DC control circuit 228 comprises capacitors coupled to first DC/DC control circuit 226 for providing a power supply to source driver 214.

Figure 4:
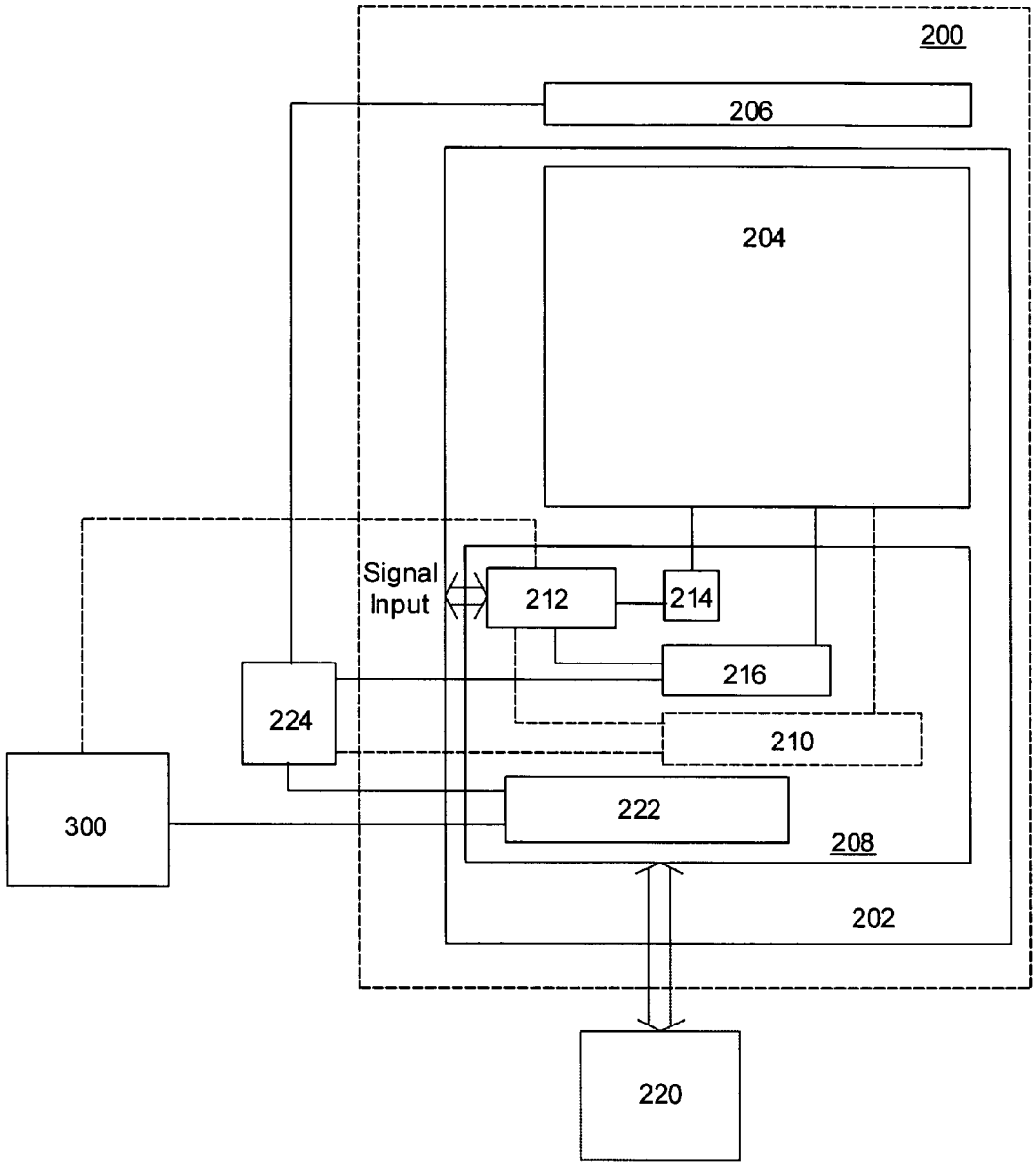
Figure 5:
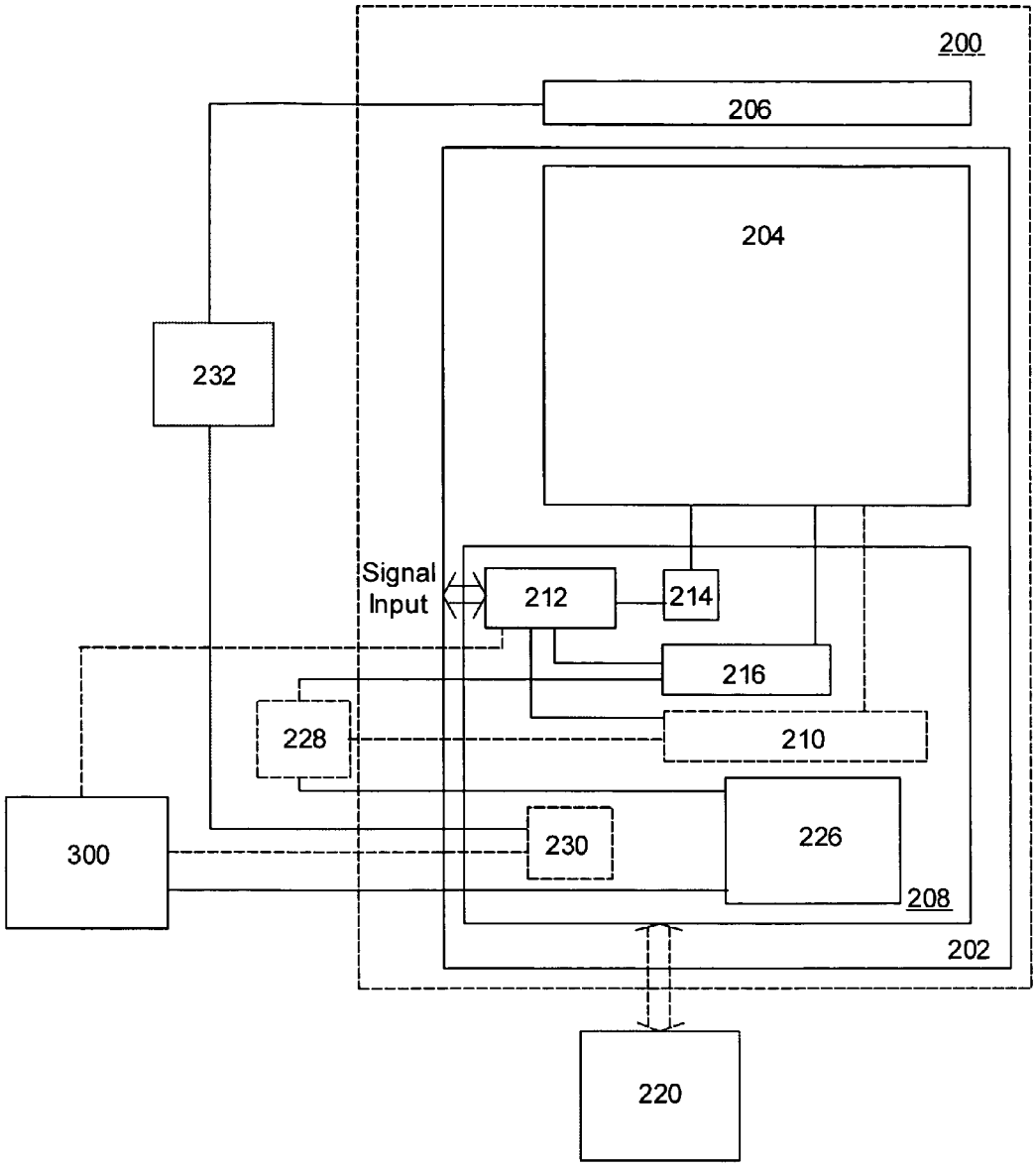

Consistent with an aspect of the present invention, gate driver 210 may be integrated into IC 208. FIG. 4 shows a configuration of LCD device 200 of FIG. 2 with gate driver 200 integrated into IC 208 and FIG. 5 shows a configuration of LCD device 200 of FIG. 3 with gate driver 200 integrated into IC 208. Other than the disposition of gate driver 210, the LCD devices shown in FIGS. 4 and 5 have the same structure as the LCD devices shown in FIGS. 2 and 3, respectively, and the same reference numbers are used in FIGS. 2-5 to refer to the same elements of the LCD device.

Figure 6:
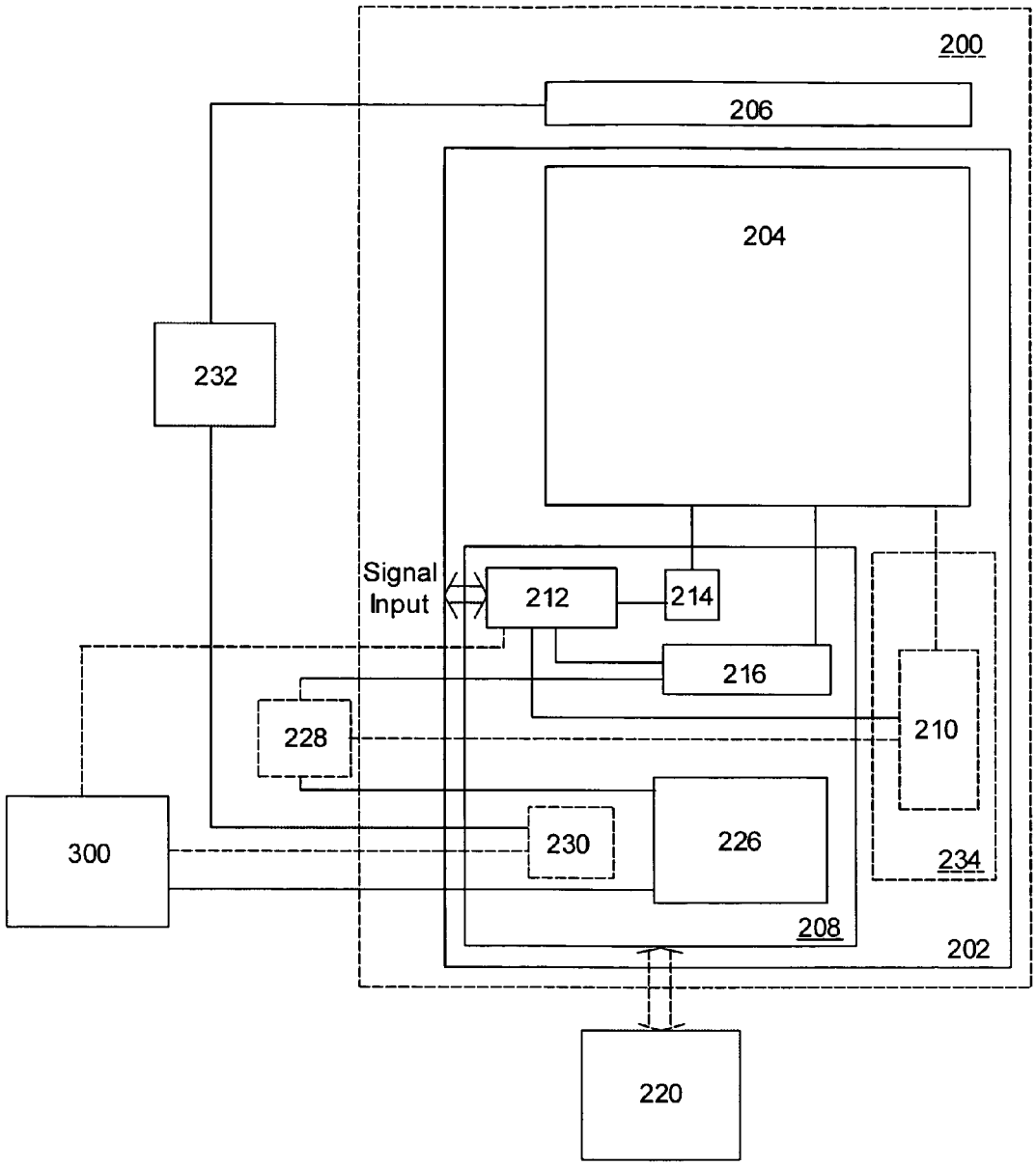

Consistent with another aspect of the present invention, gate driver 210 may be provided in an IC separate from IC 208. For example, FIG. 6 shows LCD device 200 with gate driver 210 provided in an IC 234, wherein IC 234 is also mounted on substrate 202 using the COG technique. Otherwise, the LCD device shown in FIG. 6 has the same structure as the LCD device shown in FIG. 3, and the same reference numbers are used in FIGS. 3 and 6 to refer to the same elements of the LCD device.

Other embodiments of the invention will be apparent to those skilled in the art from consideration of the specification and practice of the invention disclosed herein. Variations of the LCD device may be made without deviating from the spirit of the present invention. For example, with gate driver 210 being provided in IC 230 separate from IC 208, DC-to-DC converter 226 may be provided external to LCD device 200 for generating a power supply for light source 206, or the power supply for light source 206 may be generated by peripheral circuit 224. Similarly, gate driver 210 may be integrated into IC 208 with peripheral circuit 224 generating all power supplies for source driver 212, common voltage circuit 216, and light source 206. It is intended that the specification and examples be considered as exemplary only, with a true scope and spirit of the invention being indicated by the following claims.

What is claimed is:

1. A liquid crystal display (LCD) device connectable to a power source, comprising:

a substrate;

a panel including an array of thin film transistors provided on the substrate;

a light source for illuminating the panel; and a first integrated circuit (IC), including a timing controller for providing control signals and video signals, a source driver for receiving the control signals and video signals and driving the panel, a common voltage circuit for providing a common voltage to the panel, and a DC/DC control circuit connectable to the power source and a peripheral circuit for providing a first power supply to the light source.

2. The LCD device of claim 1, wherein the substrate comprises glass.

3. The LCD device of claim 1, wherein the panel includes a plurality of pixel elements arranged to form a triangular array known as a delta configuration.

4. The LCD device of claim 1, wherein the thin film transistors of the panel are formed using an amorphous silicon technique.

5. The LCD device of claim 1, wherein the thin film transistors of the panel are formed using a low temperature polysilicon technique.

6. The LCD device of claim 1, wherein the integrated circuit is mounted on the substrate using a chip-on-glass (COG) technique.

7. The LCD device of claim 1, wherein the first IC is connectable to a reference voltage and an amplitude of the common voltage is adjusted in accordance with the reference voltage.

8. The LCD device of claim 1, wherein the first IC further comprises a common voltage adjustment circuit for adjusting an amplitude of the common voltage.

9. The LCD device of claim 1, the first IC being connectable to a microprocessor, wherein the microprocessor is used to control the first IC.

10. The LCD device of claim 1, further comprising a gate driver provided on the substrate for driving the panel, wherein the gate driver is coupled to receive the control signals and video signals from the timing controller.

11. The LCD device of claim 10, wherein the gate driver comprises thin film transistors.

12. The LCD device of claim 11, wherein the thin film transistors of the gate driver are formed on the substrate at the same time the thin film transistors of the panel are formed.

13. The LCD device of claim 1, wherein the first IC further comprises a gate driver for driving the panel, wherein the gate driver is coupled to receive the control signals and video signals from the timing controller.

14. The LCD device of claim 1, further comprising a second IC including a gate driver for driving the panel, wherein the gate driver is coupled to receive the control signals and video signals from the timing controller.

15. The LCD device of claim 14, wherein the second IC is mounted on the substrate using a chip-on-glass technique.

16. The LCD device of claim 1, wherein the timing controller is connectable to the power source.

17. The LCD device of claim 1, wherein the peripheral circuit comprises a common voltage adjustment circuit for providing a reference voltage to the common voltage circuit for adjusting an amplitude of the common voltage.

18. The LCD device of claim 1, further comprising a gate driver, wherein the DC/DC control circuit further provides a second power supply to the gate driver.

19. The LCD device of claim 1, wherein the peripheral circuit is provided on a printed circuit board.

20. A liquid crystal display (LCD) device connectable to a power source, comprising:

a substrate;

a panel including an array of thin film transistors provided on the substrate;

a light source for illuminating the panel; and a first integrated circuit (IC) mounted on the substrate using a chip-on-glass (COG) technique, including a timing controller connectable to the power source for providing control signals and video signals, a source driver for receiving the control signals and video signals and driving the panel, a common voltage circuit for providing a common voltage to the panel, a first DC/DC control circuit connectable to the power source for providing one or more power supplies to the LCD device, and a second DC/DC control circuit connectable to both the power source and a peripheral circuit for generating a power supply for the light source.

21. The LCD device of claim 20, wherein the substrate comprises glass.

22. The LCD device of claim 20, wherein the panel includes a plurality of pixel elements arranged to form a triangular array known as a delta configuration.

23. The LCD device of claim 20, wherein the thin film transistors of the panel are formed using an amorphous silicon technique or a low temperature polysilicon technique.

24. The LCD device of claim 20, wherein the first IC is connectable to a reference voltage and an amplitude of the common voltage is adjusted by the reference voltage.

25. The LCD device of claim 20, wherein the first IC further comprises a common voltage adjustment circuit for adjusting an amplitude of the common voltage.

26. The LCD device of claim 20, the first IC being connectable to a microprocessor, wherein the microprocessor is used to control the first IC.

27. The LCD device of claim 20, further comprising a gate driver provided on the substrate for driving the panel, wherein the gate driver is coupled to receive the control signals and video signals from the timing controller.

28. The LCD device of claim 27, wherein the gate driver comprises thin film transistors.

29. The LCD device of claim 28, wherein the thin film transistors of the gate driver are formed on the substrate at the same time the thin film transistors of the panel are formed.

30. The LCD device of claim 20, wherein the first IC further comprises a gate driver for driving the panel, wherein the gate driver is coupled to receive the control signals and video signals from the timing controller.

31. The LCD device of claim 20, further comprising a second IC including a gate driver for driving the panel, wherein the gate driver is coupled to receive the control signals and video signals from the timing controller, and wherein the second IC is mounted on the substrate using a chip-on-glass technique.

32. The LCD device of claim 20, wherein the timing controller is connectable to the power source.

33. The LCD device of claim 20, further comprising a gate driver, wherein the first DC/DC control circuit comprises a charge pump connectable to capacitors for providing a power supply to the gate driver and the common voltage circuit.

34. The LCD device of claim 20, wherein the first DC/DC control circuit is connectable to capacitors for providing a power supply to the source driver.

35. The LCD device of claim 20, wherein the first DC/DC control circuit is connectable to a peripheral circuit, wherein the peripheral circuit is provided on the substrate.

36. The LCD device of claim 20, wherein the first DC/DC control circuit is connectable to a peripheral circuit, wherein the peripheral circuit is provided on a printed circuit board.

* * * * *